United States Patent [19]

Gaburri

[11] 3,938,294

[45] Feb. 17, 1976

[54] METHOD OF ERECTING A FRAME STRUCTURE FOR BUILDINGS

[76] Inventor: Leon Battista Gaburri, Piazza Partigiani, 29 - Alassio (Savona), Italy

[22] Filed: May 8, 1974

[21] Appl. No.: 467,994

Related U.S. Application Data

[60] Division of Ser. No. 84,325, Oct. 27, 1970, which is a continuation-in-part of Ser. No. 763,123, Sept. 27, 1968, abandoned.

[30] Foreign Application Priority Data

Mar. 30, 1968 Italy ..... 14667/68

[52] U.S. Cl. ..... 52/743; 29/460; 52/423; 52/724; 52/725

[51] Int. Cl.[2] ..... E04B 1/00

[58] Field of Search ..... 29/460; 52/236, 439, 423, 52/724, 725, 153, 259, 744 X, 743

[56] References Cited

UNITED STATES PATENTS

| | | | |
|---|---|---|---|
| 1,038,440 | 9/1912 | Robinson | 52/724 X |
| 1,135,721 | 4/1915 | Robinson | 52/724 X |
| 1,622,212 | 3/1927 | Shields | 52/725 X |
| 2,294,554 | 9/1942 | Henderson | 52/423 X |
| 3,355,852 | 5/1967 | Lally | 52/423 X |

FOREIGN PATENTS OR APPLICATIONS

| | | | |
|---|---|---|---|
| 379,700 | 9/1932 | United Kingdom | 52/236 |

*Primary Examiner*—Charlie T. Moon
*Attorney, Agent, or Firm*—Hane, Baxley & Spiecens

[57] ABSTRACT

The frame or skeleton of a building is erected by anchoring columns or studs in upright position and then fitting upon each upright a tubular casing prefabricated of concrete or other suitable cementitious material thereby sheathing the uprights. The space left in the casings is filled with hardening cementitious material for tying the uprights to their casings. Cross beams are joined to the uprights by providing at the upper end of each upright one or more lengthwise recesses in each of which is seated the end of one cross beam. Such joints support the cross beams safely yet permit limited adjustment of the cross beams and uprights relative to each other thereby imparting to the frame structure an inherent elasticity enabling the same to withstand high wind pressures and seismic shocks. Moreover, frame structures can be erected much faster and cheaper than heretofore possible by means of the simplified joints between upright and cross beams.

4 Claims, 14 Drawing Figures

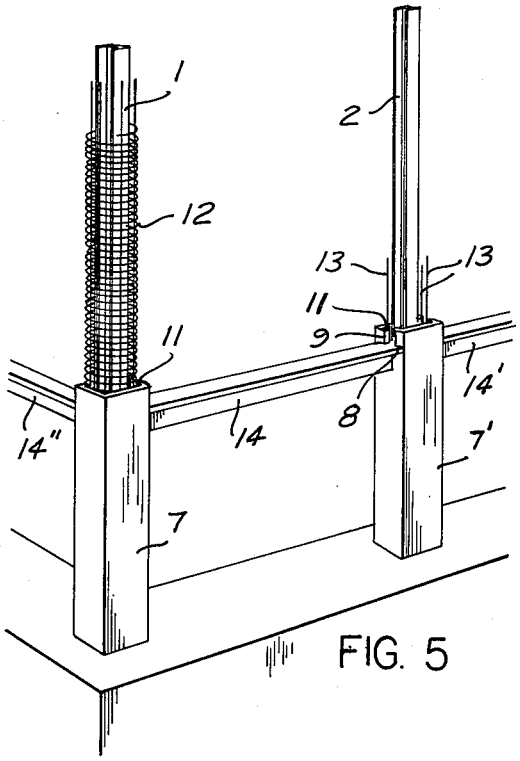
FIG. 5
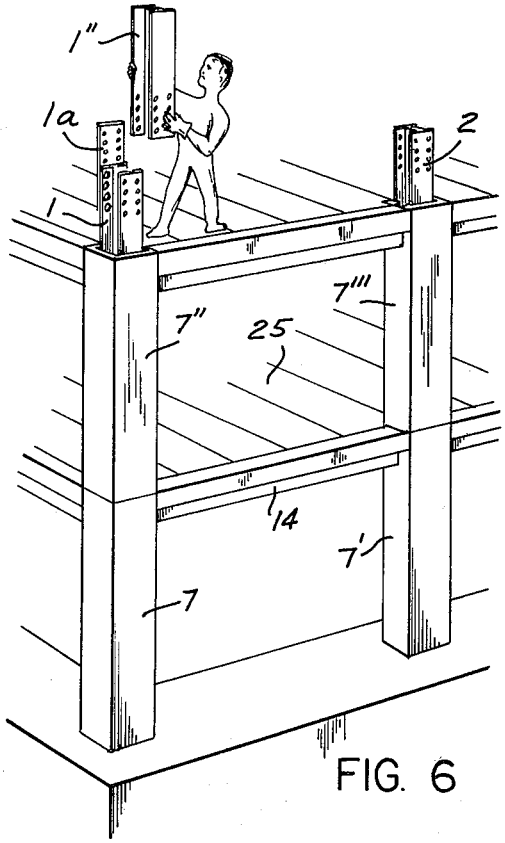
FIG. 6
FIG. 7
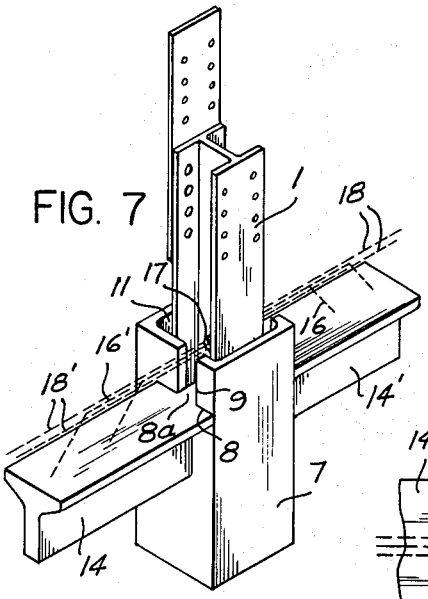
FIG. 7a
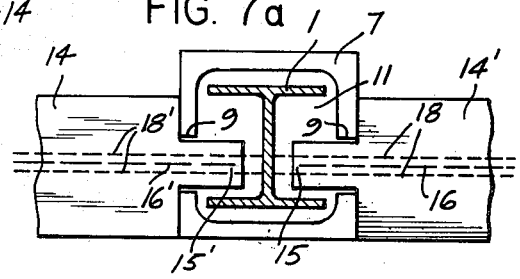

FIG. 8a
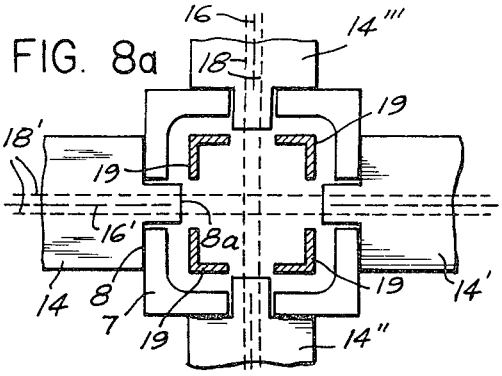
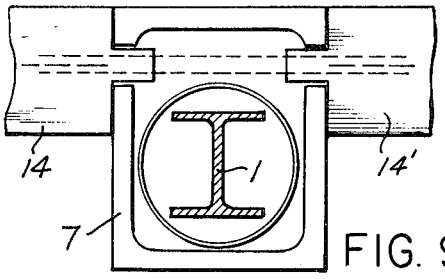
FIG. 9
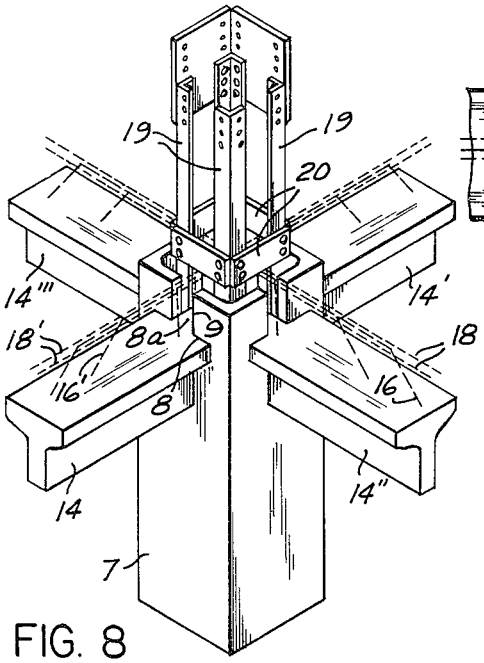
FIG. 8
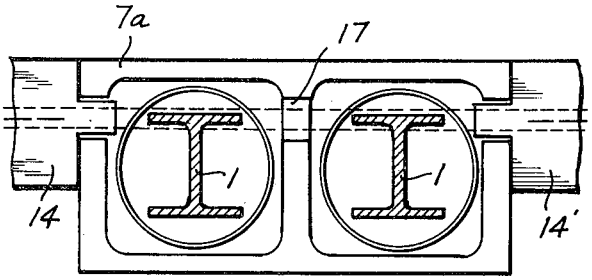
FIG. 10
FIG. 11
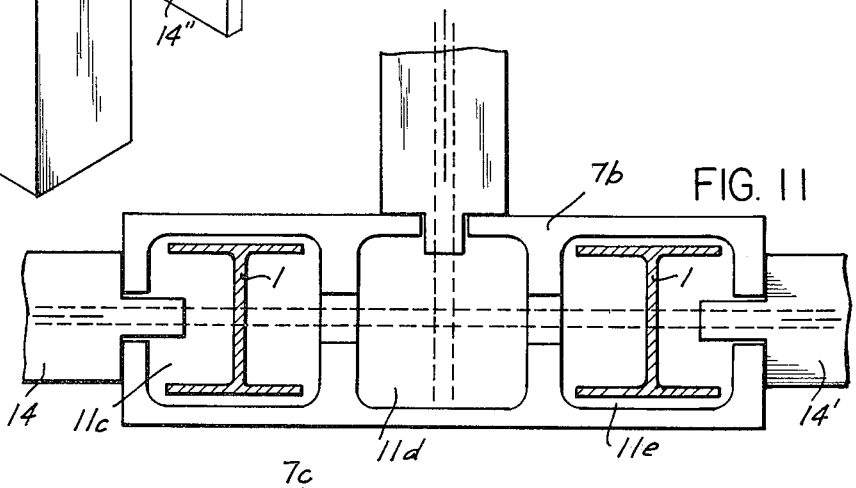
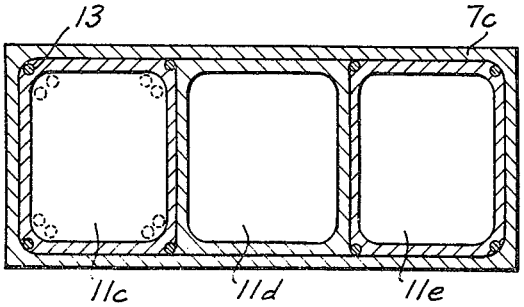
FIG. 12

METHOD OF ERECTING A FRAME STRUCTURE FOR BUILDINGS

The present application is a division of my pending application Ser. No. 84,325, filed Oct. 27, 1970, which is a continuation-in-part application based upon my application Ser. No. 763,123, filed Sept. 27, 1968 and now abandoned.

The invention relates to a novel and improved method of erecting building structures, both high rise and low building structures, and particularly to buildings the load-bearing structure of which consists of a skeleton or frame structure.

BACKGROUND

The skeleton or frame structure of buildings of the general kind above referred to is generally erected by constructing upright steel beams or columns suitably anchored in a foundation or to each other when the height of the building requires more than one length of uprights. The horizontal or cross beams are secured to the uprights at levels selected in accordance with the desired number and height of the stories of the building. The cross beams are rigidly secured to the uprights by riveting, welding, use of ties and other fastening means customarily used in the building industry whereby the finished frame structure is essentially rigid in its entirety unless complex and expensive steps are taken to impart some elasticity to the joints. The uprights in the frame structure when the same is completed or as it is being erected, depending upon the desired final height of the structure, are sheathed with concrete which may or may not be reinforced. Such sheathing requires time consuling and hence expensive assembly and disassembly of molds in situ. It is also known to use pre-fabricated slabs but such slabs must be joined which also requires extensive assembly and disassembly of molds in situ.

As the finished building is essentially a rigid structure, heavy horizontal wind pressure and seismic shocks tend to cause cracks in the sheathing and possibly more extensive damage to the building such as partial or complete collapse if the seismic shocks are of great magnitude. Even if the building is not damaged by external forces, cracks tend to develop in the sheathing of the frame structure as the sheatings tend to settle and to contract or expand due to the influence of moisture and temperature.

Joining of the cross beams to the uprights by riveting, welding, use of ties, etc. is expensive and time consuling as it requires highly skilled labor, the more so, as the cross beams and the uprights generally do not fit perfectly but must more often than not, be carefully adjusted by use of ties and brackets. In Today's labor market the costs of erecting a building are primarily controlled by labor costs rather than by the costs of material. Hence, erection of a building, particularly of a high rise building with the methods now conventionally used for erecting such buildings is time consuming and is very often highly desirable for reasons other than costs that a building be completed as soon as possible.

Moreover, all stress and other calculations must be specifically made for each building and prefabricated components can generally be used only for one type of construction.

THE INVENTION

Another important object of the invention is to provide a novel and improved building the load-bearing skeleton or frame structure of which can be erected much more rapidly and requires less labor especially less skilled labor than is required for erecting similar load-bearing skeleton or frame structures by methods as heretofore known and used.

It is also an object of the invention to provide a novel and improved method of erecting a load-bearing skeleton or frame structure that is highly resistant to horizontal wind pressures and seismic shocks, in much shorter time than was heretofore possible and at much lower labor costs than comparable skeleton or frame structures erected by now conventional methods.

SUMMARY OF THE INVENTION

The afore pointed out objects, features and advantages and other objects, features and advantages which will be pointed out hereinafter, are obtained by erecting uprights such as steel columns or studs or also suitably reinforced prefabricated concrete piles on the selected foundation for the building. The uprights are then encased by slipping upon the same the prefabricated tubular concrete casings which may be reinforced, if necessary. The encased uprights serve as supports for the horizontal or cross beams which are joined to the uprights by inserting the ends of the beams into slots formed at the top ends of the casings so that the beams and the uprights can move relative to each other within controlled limits. As a result, the frame structure has a built-in elasticity which enables it to absorb wind pressures and seismic shocks to a high degree.

Joining of the cross beams to the uprights by simply inserting the beam ends into the slots of the uprights, reduces to a minimum the time and labor required for making the joints. The spaces left within the casings and the uprights therein are filled, preferably prior to the insertion of the cross beams, by pouring a suitably hardening cementitious material into these spaces. If desired or necessary, reinforcement elements such as coils or rods may be inserted into the spaces within the casings prior to filling the same.

The use of prefabricated casings permits construction thereof much more rapidly and, hence, at lower costs than construction of the casings in situ by means of molds which must be first assembled and then disassembled. Moreover, prefabrication of the casings in a plant permits thorough testing thereof as to flaws and stress resistance which is obviously not possible when the casings are produced in situ.

DETAILED DESCRIPTION OF THE INVENTION

In the accompanying drawings several preferred embodiments of the invention are shown by way of illustration and not by way of limitation.

In the drawings:

FIG. 5 is a perspective view of the frame structure of FIG. 3 and showing reinforcements for the casing and the uprights;

FIG. 6 is a perspective view of a still further advanced stage of the frame structure showing several stories constructed with structural components according to the invention;

FIG. 7 is a perspective detailed view of a joint between an upright and cross beams;

FIG. 7*a* is a plan view of FIG. 7;

FIG. 8 is a perspective view of another type of joint between an upright and cross beams;

FIG. 8*a* is a plan view of FIG. 8;

FIG. 9 is a plan view of a modified upright and cross beams joined thereto;

FIG. 10 is a plan view of another modification of an upright and cross beams joined thereto;

FIG. 11 is a plan view of still another modification of an upright and of cross beams joined thereto; and FIG. 12 is a cross sectional view of a casing for an upright, generally of the kind as shown in FIG. 11.

Figure 1:
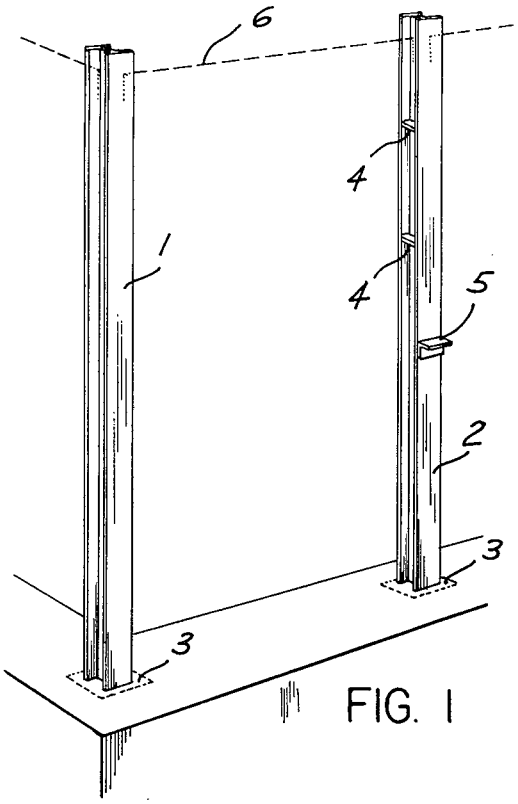
FIG. 1 is a perspective view of two upright beams constituting part of a frame structure erected according to the invention and anchored in a foundation.
Figure 2:
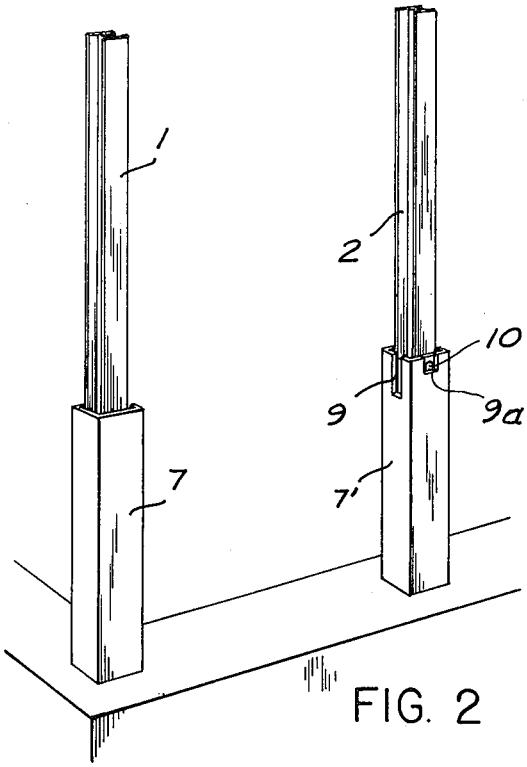
FIG. 2 is a perspective view similar to FIG. 1 but showing the frame structure in a more advanced stage.

Referring now to the FIGURES more in detail and first to FIGS. 1 and 2, the skeleton of the frame structure part exemplified in these figures comprises uprights 1 and 2 shown as I-beams anchored by conventional means in a foundation 3. Instead of I-beams, other types of beams such as I-beams or L-beams may, of course, also be used within the concept of the invention. Moreover, prefabricated concrete piles, reinforced if necessary, may be used as uprights.

The height of the uprights is selected in accordance with the dimensions of the building to be erected. Each upright may have the length of one or several stories. If the total height of the building requires joining of several uprights, the uprights may be joined in a conventional manner by ties or brackets 1*a* as it is shown in FIG. 6. These ties or brackets are joined to the cross arms of the beams by welding, riveting or screw bolts. The load-bearing capabilities of the uprights such as steel beams are selected in accordance with the required load bearing capability.

As will be more fully described hereinafter, the uprights will be eventually embedded in concrete. To improve the adhesion between the uprights and the concrete, brackets may be secured thereto as it is shown at 4 and 5 in FIG. 1. These brackets are preferably secured to the uprights already in the plant, that is, before anchoring the uprights in the foundation to keep the work to be performed in situ at a minimum.

Spreaders or spacers 6 may be temporarily attached to the uprights to retain the same in the correct position during the erection and anchoring of the same.

After installation of uprights such as uprights 1 and 2 tubular casings 7 and 7′ are slipped upon the uprights. These casings are prefabricated of concrete which may be reinforced to the extent necessary by conventional means. As the casings are not produced in situ but in the plant, they can be conveniently and thoroughly tested as to flaws, stresses and dimensions thereby precluding cracking and settling of the casings after installation to the largest possible extent. The casings which constitute a sheathing for the uprights have generally a height matching the desired height between two stories of the building. Each of the casings has at its upper edge one or more lengthwise recesses 9 as it is shown in FIG. 2. These recesses are formed already in the plant and as will be more fully described hereinafter, constitute seats for the cross beams. At this point it should be mentioned that each recess serves to receive and seat one end of a cross beam. Accordingly, depending upon the number of cross beams supported by a casing one or more recesses must be provided in the upper ends of the casing walls.

In addition to recesses 9 used as seats for the cross beams, a recess 9a may be provided at the upper edge of the casing. This recess serves to facilitate gripping of a casing for lifting or lowering by a hoist during installation of a casing. A hook 10 is indicated for the purpose.

Figure 3:
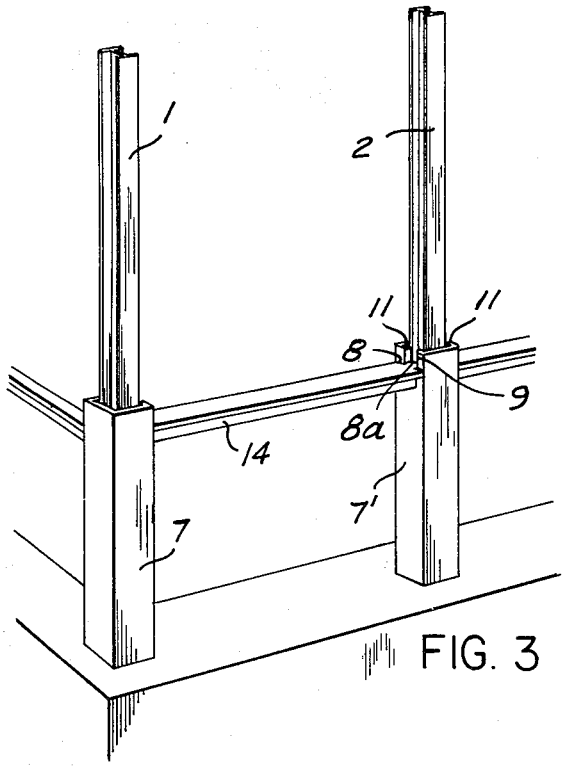
FIG. 3 is a perspective view of the same frame structure in a still more advanced stage by showing cross beams joined to the uprights.

The casings are so dimensioned with reference to the uprights therein that spaces 11 are left within the casings as is indicated in FIG. 3. These spaces are filled with hardening cementitious material such as concrete to about the level of recesses 9 thereby tying the casings to the uprights. If desired, reinforcing metal coils 12 can be inserted into spaces 11 prior to filling the same with concrete as it is shown in FIG. 5. Instead of, or in addition to reinforcing coils, rods 13 which may be pre-stressed, may also be inserted into the spaces.

Figure 4:
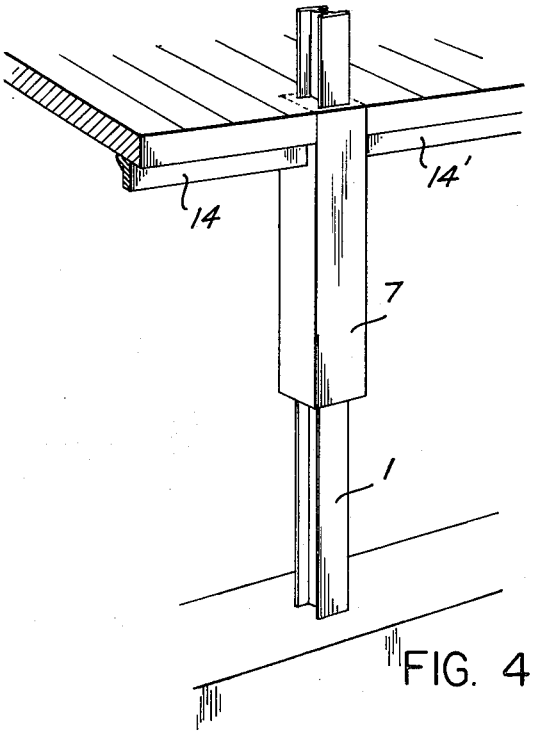
FIG. 4 is a perspective view showing a modification of the casing and a floor structure joined to an upright.

When the concrete poured into the spaces 11 has set the uprights are ready for receiving the horizontal or cross beams. There are shown in FIGS. 3, 4 and 5 respectively, cross beams 14, 14′ and 14″. These cross beams may be steel girders of any desired or suitable cross section. They may also be, preferably reinforced, concrete beams of suitable cross section. In any event, it is essential that the cross beams are also prefabricated structural components.

The cross beams have at each end cut-outs 8 forming a tongue or header 8*a* extending into recess 9. As it is clearly shown in FIG. 3 and also in other figures, the shoulders of the cut-outs rest against the walls of the casings while the tongues 8*a* are seated on the base of recess 9. While thus holding the cross beams in position, the tongues permit a slight relative movement of the cross beams relative to the uprights thereby providing the desired inherent elasticity of the frame structure. Finally, the remaining space in the upper ends of the casings is filled with hardening cementitious material to lock the casings, the uprights and cross beams one to another.

While it is preferable to fill the casings with concrete prior to mounting the cross beams, it is within the scope of the invention to insert the cross beams first.

FIG. 4 shows a frame structure in which casing 7 is shorter than the height between two stories. In other words, part of upright 1 remains exposed. In the structure of FIG. 4, the casing is safely retained in its position by the adhesion of the concrete to the upright and the casing. As pointed out before, the force of such adhesion is preferably increased by brackets 4 and 5 so that there is practically no danger of downward sliding of the casing.

FIG. 6 shows a frame structure in which two stories have already been completed in the manner previously described and a third story is in progress. Upper casings 7″ and 7‴ have been placed upon lower casings 7 and 7′ and a workman is shown adding an upper beam 1 inch to lower beam 1 by means of ties or brackets 1a as previously described. To facilitate such assembly the length of the lower uprights 1 and 2 is preferably such that the uprights protrude above the floor 25 of the second story.

FIGS. 7 and 7a show a joint or knot between upright 1 sheathed by casing 7 and two cross beams 14 and 14′ in greater detail. The cross beams are shown by way of example as being of the T-shaped reinforced concrete type. Each cross beam has at its end headers 15 and 15' similar to the shoulders and tongues 8 and 8a previously described. The headers rest on the base of recesses 9 as also previously described and extend more or less deeply into the spaces 11 within casing 7, depending upon the length of the joint desired for the beams.

If desirable, the length of the joint and thus also the continuity of the frame structure may be increased and strengthened by using rods 16 and 16' extending through a hole 17 in the web of beam 1. Further rods 18 and 18' may be placed above rods 16 and 16' as it is clearly shown in FIGS. 7 and 7*a*. These rods are conventionally placed upon the cross arms of the beams so as to facilitate the connection between the cross beams and the floor 20 shown in FIG. 6.

FIGS. 8 and 8a show a joint which is similar to the joint shown in detail in FIGS. 7 and 7a, except that four cross beams 14, 14', 14'' and 14''' are joined to casing 7. Accordingly, a recess 9 is provided in each wall of the casing. The ends of the cross beams are headed as described in connection with FIGS. 7 and 7*a*.

The upright shown in FIGS. 8 and 8*a* is in the form of a stud or column consisting of four angle irons 19 joined to each other by ties 20 so as to hold the angle irons in a rectangular cross section. Brackets 19a may be used to extend the upright thus formed to the desired height. The afore described rods, 16, 16', 18 and 18' may rest upon ties 20, if desired.

As it is evident, uprights of the kind previously shown may be used in the frame structure of FIGS. 8 and 8*a* and conversely the uprights of FIGS. 8 and 8*a* may also be used in the frame structures previously described.

FIG. 9 shows an upright in the form of an I-beam which is disposed eccentrically with respect to casing 7 and thus with respect to the cross beams 14 and 14'.

FIG. 10 shows a frame structure in which an upright is formed by two I-beams or columns 1 placed in a common casing 7*a* in which two lengthwise spaces 11*a* and 11*b* are formed. These spaces are both filled with hardened cementitious material as previously described.

FIG. 11 shows a structure in which two I-beams 1 are sheathed by a common casing 7*b*. This casing is formed with three spaces 11*c*, 11*d* and 11*e*. The beams are inserted into the two outer spaces. All three spaces are eventually filled with concrete as previously described.

FIG. 12 shows a cross section of a casing with three spaces or lengthwise cavities therein as described in FIG. 11. FIG. 12 also shows that the concrete is reinforced by rods 13.

While the invention has been described in detail with respect to certain now preferred examples and embodiments of the invention, it will be understood by those skilled in the art, after understanding the invention, that various changes and modifications may be made without departing from the spirit and scope of the invention, and it is intended, therefore, to cover all such changes and modifications in the appended claims.

I claim:

1. A method of erecting a frame structure for a building which frame structure is highly resistant to wind pressure and seismic shocks while being erected and when being completed, said method comprising the steps of:

first anchoring prefabricated studs in upright position and spaced apart in a foundation;

then fitting upon each stud a prefabricated one-piece tubular concrete casing member with an inner cross-sectional area larger than the outer cross-sectional area of the studs and having joining means including at least one receiving recess at the upper end of the casing member;

then filling the remaining space between each casing member and the stud therein with an initially flowable but hardening cementitious mass; and then inserting into each of said recesses of the joining means an end of a cross beam of a length spanning two adjacent casing members to locate and support said cross beam in horizontal position.

2. The method according to claim 1 and comprising the further step of filling the remaining space in the recess at the upper end of the casing members with an initially flowable but hardening cementitious mass to anchor the cross beams, the casing members and the studs one to another.

3. The method according to claim 1 and comprising the further step of inserting reinforcing members into the space between the studs and the casing members prior to filling said space with the cementitious mass.

4. The method according to claim 3 and comprising the further steps of placing reinforcement members upon said cross beams, and then pouring hardening cementitious mass upon said reinforcing members and the adjacent casing member portions to anchor said reinforcing members together and to the cross beams.

* * * * *